US007781730B2

(12) United States Patent
Funsten

(10) Patent No.: US 7,781,730 B2
(45) Date of Patent: Aug. 24, 2010

(54) LINEAR ELECTRONIC FIELD TIME-OF-FLIGHT ION MASS SPECTROMETERS

(75) Inventor: Herbert O. Funsten, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 351 days.

(21) Appl. No.: 12/150,576

(22) Filed: Apr. 28, 2008

(65) Prior Publication Data

US 2008/0277577 A1 Nov. 13, 2008

Related U.S. Application Data

(63) Continuation-in-part of application No. 11/354,353, filed on Feb. 14, 2006, now Pat. No. 7,385,188.

(51) Int. Cl.
*H01J 49/40* (2006.01)
*H01J 49/00* (2006.01)

(52) U.S. Cl. ..... 250/287; 250/286; 250/281; 250/423 R

(58) Field of Classification Search ..... 250/287, 250/286, 281, 423 R
See application file for complete search history.

(56) References Cited

U.S. PATENT DOCUMENTS 5,118,937 A 6/1992 Hillenkamp et al.
5,168,158 A 12/1992 McComas et al.
5,498,545 A 3/1996 Vestal
6,717,131 B2 * 4/2004 Holle et al. ..... 250/282
6,806,467 B1 * 10/2004 Funsten et al. ..... 250/287
6,812,455 B2 11/2004 Hillenkamp et al.
6,903,334 B1 6/2005 Makarov et al.
7,019,446 B2 3/2006 Funsten et al.
7,109,480 B2 9/2006 Vestal et al.
7,193,206 B2 3/2007 Bai et al.
7,217,918 B1 5/2007 Funsten et al.
7,294,830 B2 * 11/2007 Hieftje et al. ..... 250/287
7,385,188 B2 * 6/2008 Funsten et al. ..... 250/287
2005/0067932 A1 3/2005 Funsten et al.
2007/0187584 A1 8/2007 Funsten et al.

OTHER PUBLICATIONS

Hamilton et al., "New high-resolution electrostatic ion mass analyzer using time-of-flight," Rev. Sci. Instrum., vol. 61, 1990, pp. 3104-3106.

* cited by examiner

*Primary Examiner*—Nikita Wells
(74) *Attorney, Agent, or Firm*—Juliet A. Jones

(57) ABSTRACT

Time-of-flight mass spectrometer comprising a first drift region and a second drift region enclosed within an evacuation chamber; a means of introducing an analyte of interest into the first drift region; a pulsed ionization source which produces molecular ions from said analyte of interest; a first foil positioned between the first drift region and the second drift region, which dissociates said molecular ions into constituent atomic ions and emits secondary electrons; an electrode which produces secondary electrons upon contact with a constituent atomic ion in second drift region; a stop detector comprising a first ion detection region and a second ion detection region; and a timing means connected to the pulsed ionization source, to the first ion detection region, and to the second ion detection region.

19 Claims, 4 Drawing Sheets

LINEAR ELECTRONIC FIELD TIME-OF-FLIGHT ION MASS SPECTROMETERS

CROSS REFERENCE TO RELATED APPLICATION

This application is a continuation-in-part of U.S. patent application Ser. No. 11/354,353, filed Feb. 14, 2006 now U.S. Pat. No. 7,385,188.

STATEMENT OF FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD OF THE INVENTION

The present invention generally relates to mass spectrometers, and more specifically, to a single stage and a dual stage time-of-flight ion mass spectrometer using a linear electric field.

BACKGROUND OF THE INVENTION

Mass spectrometers are used extensively in the scientific community to measure and analyze the chemical compositions of substances. In general, a mass spectrometer is made up of a source of ions that are used to ionize neutral atoms or molecules from a solid, liquid or gaseous substance, a mass analyzer that separates the ions in space or time according to their mass or their mass-per-charge ratio, and a detector.

Time-of-flight mass spectrometers (TOFMS) can detect ions over a wide mass range simultaneously. See W. C. Wiley and I. H. McLaren, *Time-of-Flight Mass Spectrometer with Improved Resolution, Rev. Sci. Instrum.*, Vol. 26, No. 12, December. 1955, p. 1150. Mass spectra are derived by measuring the times for individual ions to traverse a known distance through an electrostatic field free region. In general, the mass of an ion is derived in TOFMS by measurement or knowledge of the energy, E, of an ion, measurement of the time, $t_1$, that an ion passes a fixed point in space, $P_1$, and measurement of the later time, $t_2$, that the ion passes a second point, $P_2$, in space located a distance, d, from $P_1$. Using an ion beam of known energy-per-charge E/q, the time-of-flight (TOF) of the ion is $t_{TOF}=t_2-t_1$, and by the ion speed is $v=d/t_{TOF}$. Since $E=0.5\ mv^2$, the ion mass-per-charge m/q is represented by the following equation:

$$\frac{m}{q} = \frac{2Et_{TOF}^2}{qd^2}.$$

The mass-per-charge resolution, commonly referred to as the mass resolving power of a mass spectrometer, is defined as:

$$\frac{\Delta m/q}{m/q} = \frac{\Delta E}{E} + 2\frac{\Delta t_{TOF}}{t_{TOF}} + 2\frac{\Delta d}{d}, \quad 11$$

where $\Delta E$, $\Delta t_{TOF}$, and $\Delta d$ are the uncertainties in the knowledge or measurement of the ion's energy, E, time-of-flight, $t_{TOF}$, and distance of travel, d, respectively, in conventional time-of-flight spectrometers.

In a gated TOFMS in which a narrow bunch of ions is periodically injected into the drift region, uncertainty in $t_{TOF}$ may result, for example, from ambiguity in the exact time that an ion entered the drift region due to the finite time, $\Delta t_1$, that the gate is "open," i.e. $\Delta t_1 \approx \Delta t_{TOF}$. The ratio of $\Delta t_{TOF}/t_{TOF}$ can be minimized by decreasing $\Delta t_{TOF}$, for example, by decreasing the time the gate is "open." This ratio can also be minimized by increasing $t_{TOF}$, for example, by increasing the distance, d, that an ion travels in the drift region. Often, a reflectron device is used to increase the distance of travel without increasing the physical size of the drift region.

Uncertainty in the distance of travel, d, can arise if the ion beam has a slight angular divergence so that ions travel slightly different paths, and, therefore, slightly different distances to the detector. The ratio of $\Delta d/d$ can be minimized by employing a long drift region, a small detector, and a highly collimated ion beam.

The uncertainty in the ion energy, E, may result from the initial spread of energies $\Delta E$ of ions emitted from the ion source. Therefore, ions are typically accelerated to an energy E that is much greater than $\Delta E$.

A further limitation of conventional mass spectrometry lies in the fact that the source of ions is a separate component from the time-of-flight section of a spectrometer, and it requires significant resources. First, most ion sources are inherently inefficient, so that few atoms or molecules of a gaseous sample are ionized, thereby requiring a large volume of sample and, in order to maintain a proper vacuum, a large vacuum pumping capacity. Second, the ion source typically generates a continuous ion beam that is gated periodically, creating an inefficient condition in which sample material and electrical energy are wasted during the time the gate is "closed." Third, ions have to be transported from the ion source to the time-of-flight section, requiring, among other things, electrostatic acceleration, steering and focusing. Fourth, typical ion sources introduce a significant spread in energy of the ions so that the ions must be substantially accelerated to minimize the effect of this energy spread on the mass resolving power. Finally, having an ion source separate from the drift region creates an apparatus having large mass and volume.

Still another problem with conventional time-of-flight mass spectrometers is that ions must be localized in space at time $t_1$ in order to minimize $\Delta d$ and, therefore, minimize the mass resolving power. Typically, time $t_1$ corresponds to the time that the ion is located at the entrance to the drift region.

In summary, the limitations on conventional TOFMS include a mass resolving power dependent on the energy spread of the ions emitted from the ion source; the uncertainty in the distance of travel of the ion in its flight path; the problems associated with an ion source that is separate from the drift region; and the need to localize ions in space at time $t_1$. The present invention provides various embodiments which overcome these limitations and which results in more accurate data.

SUMMARY OF THE INVENTION

The following describe some non-limiting embodiments of the present invention.

According to a first embodiment of the present invention is provided a time-of-flight ion mass spectrometer comprising an evacuated enclosure with means for generating a linear electric field located in the evacuated enclosure and means for injecting a sample material into the linear electric field. A source of pulsed ionizing radiation injects ionizing radiation into the linear electric field to ionize atoms or molecules of the sample material; and timing means determine the time elapsed between ionization of the atoms or molecules and arrival of an ion out of the ionized atoms or molecules at a predetermined position.

According to a second embodiment of the present invention, a time-of-flight mass spectrometer is provided comprising a first drift region and a second drift region enclosed within an evacuation chamber; a means of introducing an analyte of interest into the first drift region; a pulsed ionization source which produces molecular ions from said analyte of interest; a first foil positioned between the first drift region and the second drift region, which dissociates said molecular ions into constituent atomic ions and emits secondary electrons; an electrode which produces secondary electrons upon contact with a constituent atomic ion in second drift region; a stop detector comprising a first ion detection region and a second ion detection region; and a timing means connected to the pulsed ionization source, to the first ion detection region, and to the second ion detection region.

DETAILED DESCRIPTION

Figure 1:
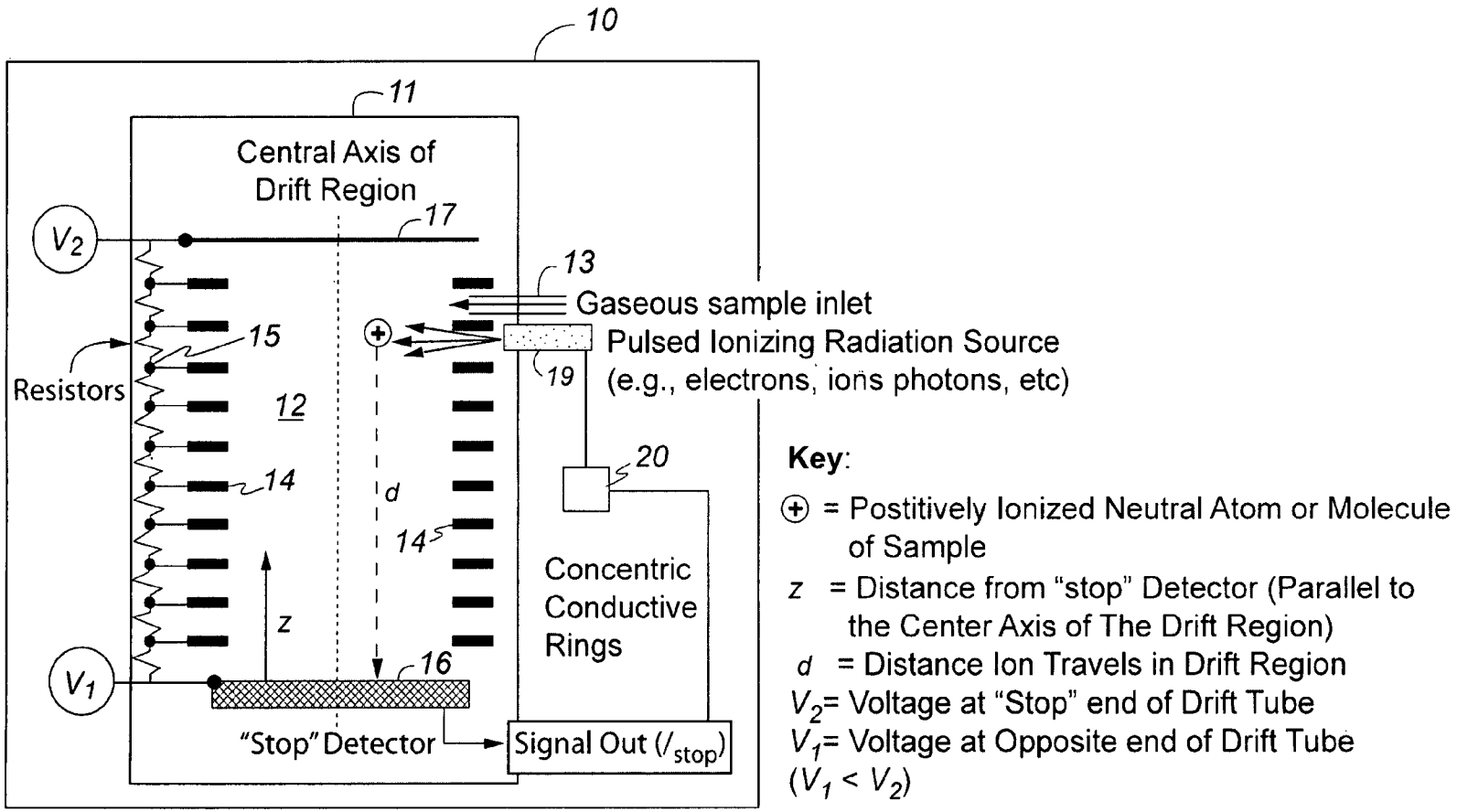
FIG. 1 is a schematic illustration of a first embodiment of the present invention showing the elements of the invention and its operation.

The present invention provides a single and a dual-stage time-of-flight mass spectrometer. In both embodiments, a sample atom or molecule is ionized within a drift region having a linear electric field. The electric field accelerates the ions toward a detector, such that the time-of-flight of an ion, from the time of its ionization to the time of its detection, is independent of the distance the ion travels in the drift region. The invention provides high mass resolving power, smaller resource requirements in such areas as mass, power, volume, and pumping capacity, and elimination of the prior art requirement that the location of an ion at time $t_1$ must be known in order to measure its time-of-flight in the drift region. The invention can be understood more easily through reference to the drawing.

Referring to FIG. 1, there can be seen a single-stage time-of-flight mass spectrometer 10 of the present invention resides inside evacuated chamber 11. The gaseous sample to be investigated is introduced into drift region 12 by sample inlet 13, where the sample is a gas. Alternatively, a solid sample could be introduced, for example, at the surface of an electrode near end plate 17. Concentric electrically conductive rings 14 surround drift region 12, and are connected to resistors 15 that are connected between voltage $V_1$ and voltage $V_2$, as shown, with $V_1$ negative with respect to $V_2$. Also as shown, $V_1$ is connected to stop detector 16, and $V_2$ is connected to end plate 17 at the opposite end of drift region 12. This arrangement provides the linear electric field in drift region 12 that is required by the present invention. The resistor values are selected to generate the linear electric field along the central axis of the drift region. Generally, the resistor values increase quadratically from stop detector 16 ($V_1$) to end plate 17 ($V_2$) for a cylindrical drift region 12.

Figure 2:
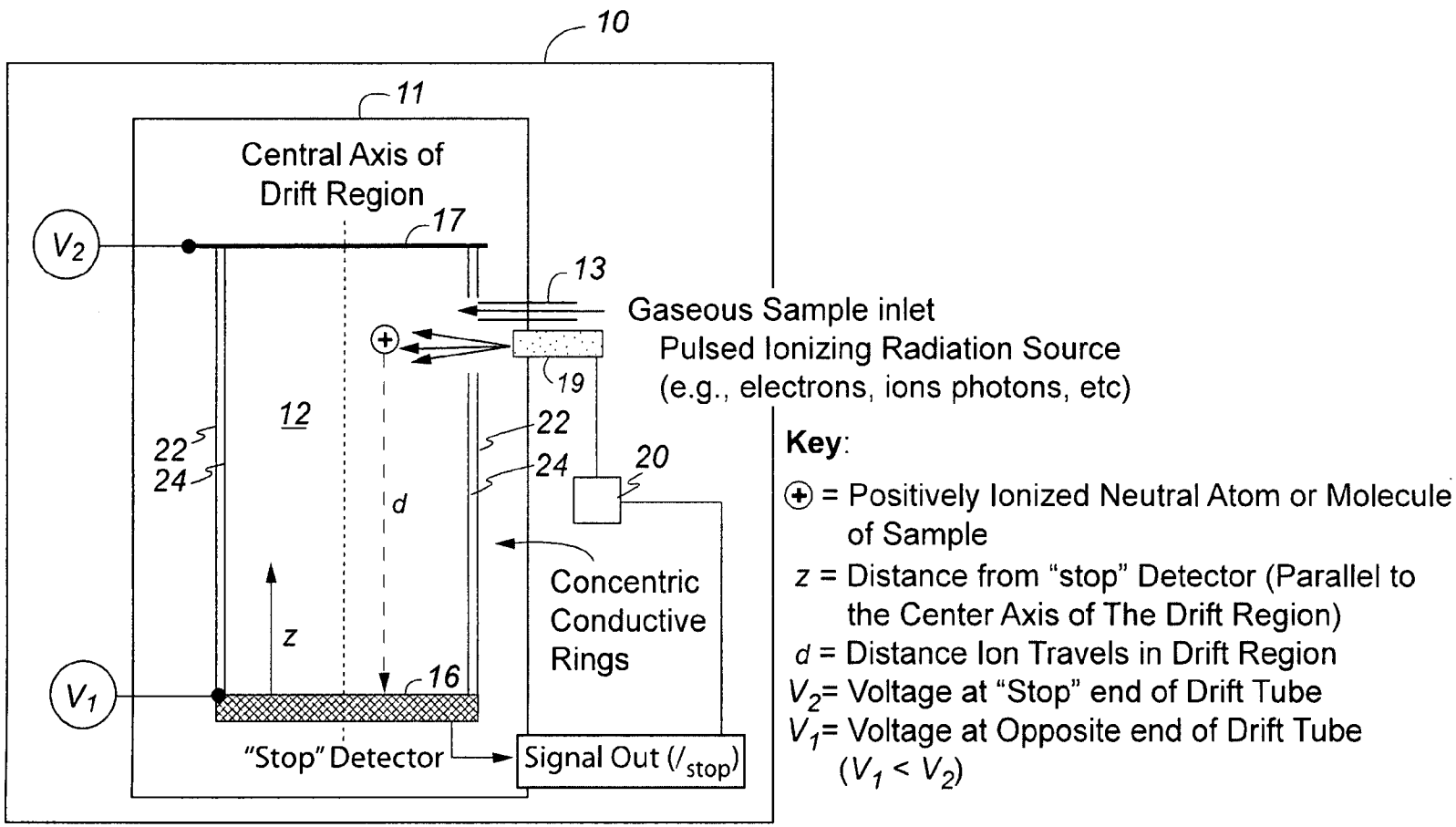
FIG. 2 is a schematic illustration of an alternative embodiment of the present invention showing a cross-sectional view of the mass spectrometer as viewed from the top.

The linear electric field created by $V_1$ and $V_2$ across resistors 15 and concentric rings 14 is coaxial about central axis (the z axis), and has a magnitude, $\epsilon(z)$, that is proportional to the distance, z, normal to stop detector 16, as shown in U.S. Pat. No. 5,168,158, issued December, 1992, to McComas et al. Although concentric ring 14 and resistors 15 effectively provide the linear electric field for the present invention, other methods can be used. For example, referring to FIG. 2, a dielectric cylinder 22 could surround drift region 12, and have a resistive coating 24 applied whose resistance varies with the distance from stop detector 16. Another electric field arrangement could involve a conically shaped grid at stop detector 16 ($V_1$) and a hyperbolic shaped grid located at end plate 17 ($V_2$) as described by D. C. Hamilton et al., in New high resolution electrostatic ion mass analyzer using time-of-flight, Rev. Sci. Instrum. Vol. 61 (1990) 3104-3106. It is also possible that combinations of these methods could be used. Any method of effectively producing a linear electric field within drift region 12 could be used with the present invention. In the single-stage mass spectrometer of the present invention, stop detector 16 can be any effective single particle detector that can measure the time that an ion strikes the detector with time accuracy much less than the ion's TOF in the drift region. One appropriate stop detector 16 is an electron multiplier detector such as a microchannel plate detector or channel electron multiplier detector that would detect ionized sample atoms or molecules that have been accelerated through drift region 12, and output a signal indicating the detection.

Ionization source 19 emits ionizing radiation into drift region 12 where it ionizes molecules and/or atoms of the sample of interest. Ionization source 19 can emit any effective ionizing radiation, such as photons, electrons, or ions and could be a laser, a source of electrons, or a source of ions. In one embodiment, the ionization source 19 is a pulsed ionization source.

In one embodiment, the ionizing radiation source 19 ionizes sample atoms or molecules at time, $t_1$, and the ionized atom or molecule is accelerated by the linear electric field toward stop detector 16, where the ionized atom or molecule is detected at time, $t_2$. The difference in times, $t_2-t_1$, corresponds to the time-of-flight of the ionized atom or molecule over the distance that it travels from the time it was ionized to the time it is detected at stop detector 16.

The general equation governing the motion of an ion in a linear electric field is:

$$-qkz = m\frac{d^2z}{dt^2}, \tag{12}$$

where q is the ion charge and k is a constant that depends only upon the electromechanical configuration of the drift region. Equation 12 has the solution of:

$$z = A\sin(\omega t + \phi) \tag{13}$$

where A and $\phi$ are determined by the initial conditions and $\omega^2 = kq/m$. A requirement of these relationships is that an ionized sample atom or molecule is initially at rest or partially at rest in the z direction. It is well known to those having skill in this art, that the mean kinetic energy of a gaseous atom or molecule is 1.5 kT, where k is the Boltzman constant, and T is the temperature of the gas. At room temperature (approximately 300 K), the mean energy is approximately 0.04 eV. This initial energy uncertainty ΔE can influence the mass resolving power according to Equation 11. To minimize ΔE/E the magnitude of the potentials generating the linear electric field must be sufficiently high to achieve the desired mass resolving power.

Under the initial conditions that stop detector 16 is located at z=0, and that the ion is created at rest at a distance of z=d from stop detector 16, the time-of-flight of the ion according to Equation 13 is:

$$t_{TOF} = \frac{\pi}{2\omega} = \frac{\pi}{2}\left(\frac{m}{qk}\right)^{\frac{1}{2}}. \quad 14$$

In contrast to a conventional linear electric field ion mass spectrometer in which an ion experiences a retarding electric field and follow a half-oscillation path of the harmonic oscillator analog, Equation 14 corresponds to acceleration over a quarter-oscillation path of the harmonic oscillator analog. Rearranging Equation 14 yields:

$$\frac{m}{q} = \frac{4kt_{TOF}^2}{\pi^2}, \quad 15$$

which, as seen, is independent of the distance of travel, d, of the ion in the accelerating linear electric field. Thus, it is clear that the advantage of an acceleration linear electric field, such as is generated in the present invention, in which sample atoms or molecules are ionized while they are considered to be at rest (or nearly so relative to the energy to which they are accelerated by the linear electric field in drift region 12) is that the ions can be created at any location in drift region 12 and they will have a time-of-flight that depends only on the mass-per-charge of the ion and on the electromechanical design of the apparatus. This also allows for a high mass resolving power according to Equation 11, since, for an ideal system, (a) the m/q is independent of the location that the ion is formed in the drift region, so that Δd/d=0, and (b) the sample atom or molecule is ionized at rest or nearly at rest and is accelerated to a high enough energy so that ΔE/E is smaller than or comparable to other factors that limit the mass resolving power described in Equation 11. Additionally, this eliminates the requirement of prior art TOFMS, including prior conventional linear electric field devices, that the ionizing radiation particles be localized at a known location at time $t_1$.

It should be noted that the prior art of retarding linear electric field devices teaches TOF mass spectrometry using half-sine-wave ion orbits in which an ion enters a drift region with high energy, but which is slowed down by the electric field so that it reverses direction at the point at which the ion has zero velocity in the z-direction. The ion then returns to and is detected at the same plane from which the ion was originally introduced into the drift region. In the present invention, an ion starts at rest from any position in drift region 12, and is accelerated by the linear electric field in one direction toward stop detector 16. This corresponds to a quarter-sine-wave particle orbit in the solution to the differential equation of motion, Equation 12.

Those with skill in this art recognize that the invention requires a power supply to provide the necessary potential differences required for $V_1$ and $V_2$ and to produce the necessary linear electric field, and for powering pulsed ionizing radiation source 19. Additionally, electronic timing means 20, (for example, one or more timing circuits) are required to measure the time between generation of the pulse from pulsed ionizing radiation source 19, and the detection of an ion at stop detector 16 or 17. One or more timing electronic circuits measuring one or more timing events may be housed in a single timing means.

Figure 3:
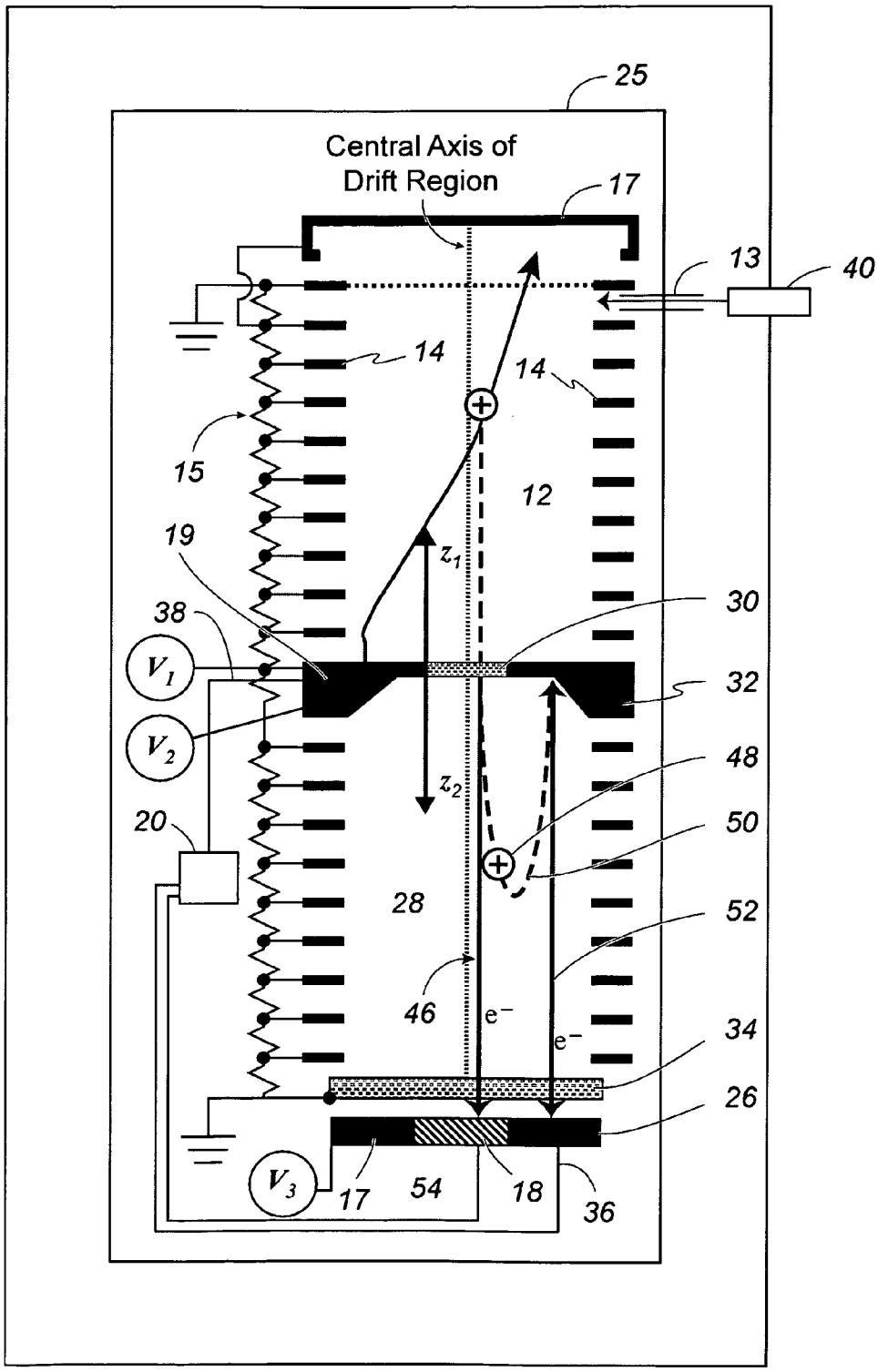
FIG. 3 is a schematic illustration of a second embodiment of the present invention depicting a cross-sectional view of a dual-stage spatially isochronous time-of-flight (SITOF) mass spectrometer, as viewed from the top.

FIG. 3 depicts one non-limiting example of a dual-stage spatially isochronous time-of-flight mass spectrometer 25, comprising a first drift region 12 and a second drift region 28, both enclosed within evacuated chamber 11. The mass spectrometer comprises a means for introducing an analyte of interest into said first drift region 12, for example, sample inlet 13. The sample may be introduced by any suitable means for injecting the sample, for example, a leak valve output from a gas chromatography analysis system. Electrically conductive rings 14 surround the first and the second drift regions 12 and 28, and are connected to resistors 15 which in turn are connected between voltage $V_1$ (measured at the electrode 32 at the interface between first drift region 12 and second drift region 28), voltage $V_2$ (measured at the ionization source 19) and the second foil 34. The resistor values are selected to generate an electric field whose magnitude increases linearly along the central axis of first drift region 12 and second drift region 28 with distance from first foil 30 and whose direction is such that positive ions are accelerated toward first foil 30, for example as shown in U.S. Pat. No. 5,168,158, issued December. 1992, to McComas et al. When the first and the second drift regions (12, 28) are substantially cylindrical in form, the electrically conductive rings 14 may be concentric electrically conductive rings.

The first drift region 12 is used to identify the mass of ionized atoms, of an ionized parent molecule, or an ionized fragment of a parent molecule that is fragmented by the ionization event, whereas the second drift region 28 is used to identify the atomic constituents of the parent molecule or its molecular fragment. Parent molecules and/or fragmented species (hereinafter referred to as "molecular ions") are ionized and are directed toward a first foil 30 placed between the first drift region 12 and the second drift region 28 and in contact with electrode 32 that is also placed between first drift region 12 and second drift region 28. At least a portion of the molecular ions pass through the first foil 30 to pass into the second drift region 28. One non-limiting example of a suitable first foil 30 is an "ultrathin carbon foil" having a nominal thickness of about 0.5 μg/cm$^2$, and is commercially available from ACF (Arizona Carbon Foil) Metals, Inc., Tucson Ariz. The first foil serves several purposes, including dissociation of a molecular ion into its constituent cationic atomic species 48 (hereinafter referred to as "atomic ions"), emission of secondary electrons 46 from the surface of the first foil that is exposed to the second drift region 28. Secondary electrons 46 from the exit surface of first foil are referred to as Stop1 electrons. For sufficient ionization efficiency of ions exiting first foil and entering second drift region, ions formed in first drift region should be accelerated to an energy of about 5 keV or greater, so a preferred embodiment is for voltage $V_1$ to be about 5 kV or greater.

Figure 4:
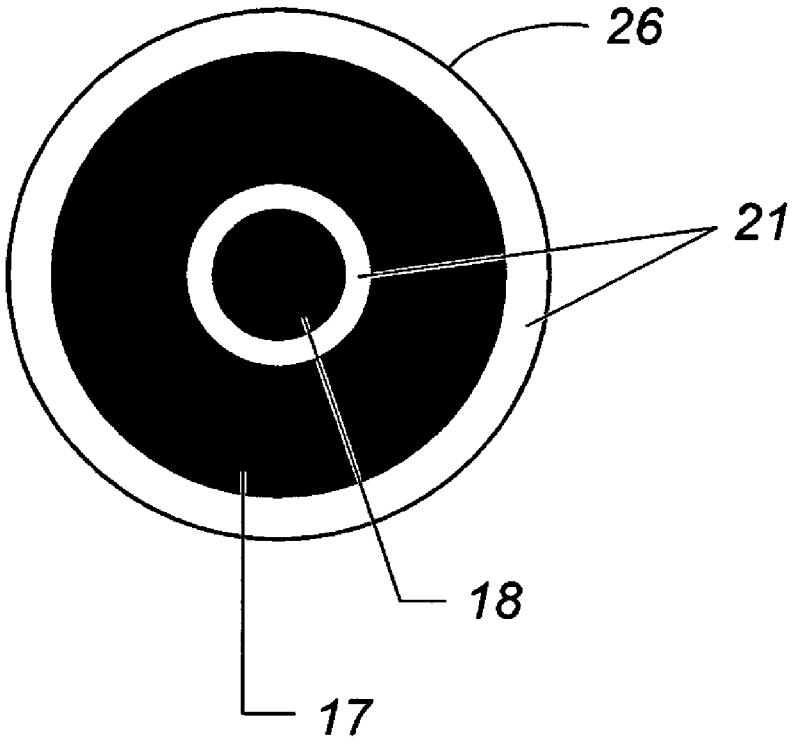
FIG. 4 is a schematic illustration of a frontal view of the anodic stop detector depicted in FIG. 3.

The Stop1 secondary electrons 46 are accelerated across the second drift region 28 and generate a signal at a first ion detection region 18 of a stop detector 26. The signal is referred to as the first stop pulse at time $t_{Stop1}$ (54). In one embodiment, the stop detector is substantially circular, or concentric, and the first ion detection region may be referred to as inner ion detection region 18 or inner disk 18. FIG. 4 depicts a frontal view of a concentric stop detector 26, comprising an inner disk 18, an outer annulus 17, and spacer materials 21. One embodiment of stop detector 26 is a circular microchannel plate detector having a conductive anode that consists of an insulating substrate such as a ceramic with attached concentric conductive anode disk and conductive anode annulus. The gap between the anode disk and anode annulus is sufficient so that signal detected on anode disk is not detected on anode annulus and vice versa.

The cationic atomic species 48 exit first foil 30, enter second drift region 28, and follow a reverse trajectory 50 formed by a retarding linear electric field and subsequently impact electrode 32, which is in contact with the first foil 30. Cationic species are deflected from the central axis of second drift region so that they can strike electrode 32 by either undergoing angular scattering as they traverse first foil 30 or by an imposed defocusing electric field in the direction perpendicular to the central axis of second drift region. The defocusing electric field can be imposed by modifying the spacing or geometry of conductive rings 14 or the resistance values of resistors 15 that define the voltage on conductive rings 14. In one embodiment, the electrode 32 forms a substantially conical surface at the entrance to the second drift region. One advantage of a substantially conical electrode 32 is that it enables a more linear electric field in second drift region 28; another advantage of a substantially conical electrode 32 is that it allows sufficient volume to place the pulsed ionization source 19. The retarding linear electric field acts as a half-period harmonic oscillator such that the time-of-flight of a cationic atomic species 48 from the time that it exits the first foil 30 to the time that it contacts the electrode 32 is independent of its energy, or "energy isochronous." The impact of the cationic atomic species 48 on the electrode 32 may generate secondary electrons 52, also referred to as Stop2 electrons, which are accelerated by the linear electric field onto a second ion detection region 17 of stop detector 26, where a signal 36 is generated. The signal generated by the Stop2 electrons 52 may be referred to as second stop pulse at time $t_{Stop2}$ (36). When the stop detector 26 is substantially circular, the Stop2 electrons 52 may be said to contact outer ion detection region 17 or outer annulus 17.

In one embodiment which does not require a second foil 34, neutral atoms and negative ions can be detected by stop detector 26 and constitute noise in the time-of-flight measurements because these neutral atoms and negative ions exit the foil over a wide range of energies and their time-of-flight across drift region 28 is not correlated with ion mass. A preferred embodiment uses a second foil 34 to reduce or eliminate this noise, wherein second foil 34 is placed between the first foil 32 and the stop detector 26, such that the second foil 34 is in close proximity to the stop detector 26. The second foil 34 serves to block neutral atomic species which exit the first foil 32, and which are unaffected by the retarding linear electric field in the second stage. The second foil 34 also serves to block negatively ionized atomic species which exit the first foil 32, and which are accelerated by the retarding linear electric field in the second stage toward the stop detector 26. The second foil 34 is typically thicker than the first "ultrathin" foil 30, having a thickness which is sufficient to inhibit (i.e. substantially block) passage of neutral and negatively ionized atoms, yet allow passage of Stop1 secondary electrons 46 and Stop2 secondary electrons 52 to the stop detector 26. The thickness of second foil 34 depends on the energy of neutral and negatively charged ions and the energy of secondary electrons 46 and 52. In one embodiment the second foil is carbon and has an average thickness of approximately 30 $\mu g/cm^2$.

The dual-stage SITOF of the present invention has a number of advantages. First, the first foil dissociates essentially all molecular species (with the exception of perhaps $H_2$) so that only the atomic constituents are measured in the second drift region 28. This removes molecular isobars (i.e., molecules having substantially the same molecular mass but different atomic composition) and allows direct elemental and isotopic measurements. The dual-stage SITOF further allows direct association of atomic constituents measured in the second stage with its parent molecule measured by time-of-flight of the parent molecule in the first stage. In contrast, conventional mass spectrometric methods rely on the probable fragmentation patterns of a parent molecule to deduce the structure of the parent molecule from a spectrum of the fragments. To accomplish this association, a timing means 20 measuring time $t_{Stop2}$ in the second drift region 28 is "slaved" or linked to a timer measuring $t_{Stop1}$, and electrically connected to the pulsed ion source 19. The ionization pulse starts timing by the timing means 20, and the subsequent times $t_{Stop1}$ and $t_{Stop2}$ are recorded relative to the start time. Each event is recorded as a sequence of measured times-of-flight, i.e., $t_{Stop2}(0)$, $t_{Stop2}(1)$, $t_{Stop2}(2)$, $t_{Stop2}(3)$, . . . $t_{Stop2}(n)$ where n is the $n^{th}$ $t_{Stop2}$ event recorded. For example, a CO molecule would be measured in the first stage at a time-of-flight corresponding to molecular ion mass 28 amu, but the fragments $C^+$ and $O^+$ could each be uniquely identified in the second stage, clearly identifying both the molecule and its atomic ion constituents. Importantly, CO would be uniquely identified in the presence of molecular $N_2$, which also has a mass of 28 amu but would dissociate in the foil and would be uniquely identified through its fragments of $N^+$ in the second stage. Therefore, measurement of mass 28 amu in the first stage followed by measurement of atomic ion $C^+$ or $O^+$ in the second stage would uniquely identify the parent molecule as CO. Alternately, measurement of mass 28 amu in the first stage followed by measurement of atomic ion $N^+$ in the second stage would uniquely identify the parent molecule as $N_2$. Finally, the second stage allows a very significant increase in the signal-to-noise ratio (and therefore accuracy) of the measurement because of the correlated measurement of an atomic ion with its parent molecule.

In one embodiment, the sample inlet 13, leak valve output 40 and pulsed ionization source 19 are replaced by a Matrix Assisted Laser Desorption/Ionization (MALDI) source 54 in which ions are generated by a pulsed laser directed at a solid analyte that is imbedded in an appropriate matrix material or placed on an appropriate solid substrate. MALDI is a method in which the laser interaction with the analyte and matrix system or the analyte and solid substrate system results in desorption and ionization of analyte molecules. The pulse of ions from a single laser pulse can subsequently be analyzed in the two-stage device. Non-limiting examples of suitable MALDI ionization sources are described in U.S. Pat. Nos. 5,118,937 (Hillenkamp et al.); 5,498,545 (Vestal); 6,812,455 (Hillenkamp et al.); 6,903,334 (Makarov, et al.); 7,193,206 (Bai et al.); and 7,109,480 (Vestal et al.).

In all embodiments of the present invention, the sample atoms or molecules are ionized inside drift region 12, not in some external ion source. This allows the invention to be inherently compact, allowing the invention to provide TOFMS apparatus that has a small volume and mass, which requires smaller sample volume, and which requires reduced power resources. In one embodiment, the mass spectrometer has a mass of less than about 10 kg, and alternatively less than about 5 kg. The ionization of sample atoms or molecules inside drift region 12 also allows the present invention to accelerate the ions from a condition of near rest independent of the ion's position within drift region 12. This allows use of a spatially broad pulsed ionizing radiation source 19 that is efficient and requires little or no steering, collimation or focusing.

The sample ion is formed when the sample atom or molecule is approximately at rest, and the time-of-flight of the sample ion in drift region 12 is independent of the location at which the sample ion was formed. Therefore, the mass resolving power of the sample ion is likely dependent primarily on the accuracy of the time-of-flight measurement, which includes, for example, the length of time that the ionizing radiation from pulsed ionizing radiation source 19 is admitted into drift region 12, the timing accuracy of the stop detector 16, and the timing accuracy of the time-of-flight measurement electronics.

The present invention requires only a small volume of sample material because the pressure of the sample in the drift region is necessarily low to prevent high voltage arcing within the device and because most ionized sample atoms or molecules are detected. This is in contrast to prior art mass spectrometers, where few ions created in the ion source are injected into the drift region because of the low efficiency of extracting ions from the ion source and because of removal of ions from the ion beam by, among other things, collimating slits, and while the gate is "closed." Additionally, due to the smaller volume of the present invention and the lower required volume of sample, the pumping requirements for evacuation of evacuated chamber 11 is reduced, allowing use of a smaller vacuum pump.

Finally, the present invention requires lower voltage differences across drift region 12. Since a sample atom or molecule is ionized while it is at thermal energies of approximately 0.04 eV at 300 K, the calculated mass-per-charge of the ion is dependent on knowledge accuracy of the ion's energy relative to its accelerated energy as it traverses drift region 12. Because the spread in the initial energies of the sample ions is small, the acceleration voltage ($V_1$-$V_2$) does not have to be high. To put this into perspective, in some conventional mass spectrometers, ions are extracted from the ion source by electrostatic means, and a potential gradient can exit within the ion source so that ions are created at different potentials that result in an energy spread that can range from about 1 eV to tens of eV, which requires acceleration of the sample ions to a high energy in order to remove the uncertainty of the energies of the sample ions. In one embodiment of the present invention, a single applied voltage (except for the signal electronics) may be applied both as the bias for stop detector 16 and for voltage $V_1$ at stop detector 16. This voltage could be −3 kV at $V_1$, and 0 V at $V_2$.

The foregoing description of the invention has been presented for purposes of illustration and description and is not intended to be exhaustive or to limit the invention to the precise form disclosed, and many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated.

What is claimed is:

1. A time-of-flight mass spectrometer comprising:

a) a first drift region and a second drift region enclosed within an evacuation chamber;

b) a means of introducing an analyte of interest into the first drift region;

c) a pulsed ionization source which produces molecular ions from said analyte of interest;

d) a first foil positioned between the first drift region and the second drift region, which dissociates said molecular ions into constituent atomic ions and emits secondary electrons;

e) an electrode which produces secondary electrons upon contact with a constituent atomic ion in second drift region;

f) a stop detector comprising a first ion detection region and a second ion detection region; and g) a timing means connected to the pulsed ionization source, to the first ion detection region, and to the second ion detection region.

2. The time-of-flight mass spectrometer of claim 1, further comprising a second foil positioned between the first foil and the stop detector, wherein said second carbon foil allows passage of electrons to the stop detector and inhibits passage of neutral species.

3. The time-of-flight mass spectrometer of claim 1, wherein the secondary electrons from said first foil contact the first ion detection region to produce a first stop pulse at time $t_{Stop1}$ and the secondary electrons from said electrode contact the second ion detection region to produce a second stop pulse at time $t_{Stop2}$.

4. The time-of-flight mass spectrometer of claim 3, wherein the timing means measures at least first stop pulse at time $t_{Stop1}$ and second stop pulse at time $t_{Stop2}$.

5. The time-of-flight mass spectrometer of claim 3, wherein the first stop pulse at time $t_{Stop1}$ is correlated to the mass of the molecular ion and the second stop pulse is correlated to the mass of the atomic ion at time $t_{Stop2}$.

6. The time-of-flight mass spectrometer of claim 1, wherein the first drift region comprises a linear electric field.

7. The time-of-flight mass spectrometer of claim 1 wherein the second drift region comprises a linear electric field.

8. The time-of-flight mass spectrometer of claim 1 wherein the constituent atomic ions form a curvilinear trajectory within the second drift region prior to contacting the said electrode.

9. The time-of-flight mass spectrometer of claim 1, wherein the first foil has a thickness of from about 0.2 μg/cm$^2$ to about 5 μg/cm$^2$.

10. The time-of-flight mass spectrometer of claim 1, further comprising a MALDI ion source.

11. The time-of-flight mass spectrometer of claim 1, wherein the stop detector is a concentric stop detector comprising an inner annulus and an outer annulus.

12. The time-of-flight mass spectrometer of claim 2 wherein the second foil has a thickness of from about 5 μg/cm$^2$ to about 50 μg/cm$^2$.

13. The time-of-flight mass spectrometer of claim 1 wherein the first foil is composed of carbon, aluminum, boron, magnesium, a composite material, an alloy, a polymer, or a nanomaterial.

14. The time-of-flight mass spectrometer of claim 13 wherein the foil is a carbon foil.

15. The time-of-flight mass spectrometer of claim 2 wherein the second foil is composed of carbon, aluminum, boron, magnesium, a composite material, an alloy, a polymer, or a nanomaterial.

16. The time-of-flight mass spectrometer of claim 15 wherein the foil is a carbon foil.

17. The time-of-flight mass spectrometer of claim 1 wherein the first foil has a voltage greater than about 5 kV.

18. The time-of-flight mass spectrometer of claim 10 wherein the MALDI ion source introduces a solid analyte.

19. The time-of-flight mass spectrometer of claim 1 wherein the mass spectrometer has a mass of less than 10 kg.

* * * * *